United States Patent [19]

Genz

[11] 4,283,608

[45] Aug. 11, 1981

[54] ELECTRICAL KEYLOCK SWITCH

[75] Inventor: Earl J. Genz, Des Plaines, Ill.

[73] Assignee: Illinois Tool Works Inc., Chicago, Ill.

[21] Appl. No.: 112,667

[22] Filed: Jan. 16, 1980

[51] Int. Cl.[3] ..... H01H 27/00

[52] U.S. Cl. ..... 200/44

[58] Field of Search ..... 200/44, 11 A

[56] References Cited

U.S. PATENT DOCUMENTS

| | | | |
|---|---|---|---|
| 3,358,093 | 12/1967 | Cryer | 200/44 |
| 3,639,708 | 2/1972 | Wolniak et al. | 200/44 |
| 3,941,954 | 3/1976 | Wintringham | 200/44 |

FOREIGN PATENT DOCUMENTS

| | | | |
|---|---|---|---|
| 2160192 | 6/1973 | Fed. Rep. of Germany | 200/44 |

*Primary Examiner*—Willis Little

*Attorney, Agent, or Firm*—Glenn W. Bowen; Thomas W. Buckman

[57] ABSTRACT

The present invention relates to electrical switches which are incorporated into a keylock, and more particularly, to switches of the type which have a rotatable mechanism which turns with the key, and fixed electrical terminals at the end of the keylock remote from the keyslot. In this type of switch, the contact member consists of a short conductive rod in a retaining cup which has a boss on its. A coiled spring is positioned over the boss on its upper end, and its lower end is retained in a blind aperture in a receptacle in the keylock. The keylock has a pair of extending arms which clamp the base with the electrical terminals of the switch in a fixed relationship with respect to the outer housing of the keylock while the conductive rod and the retaining cup rotate with the lock mechanism. The terminals have heads which are spaced from the base, and the retaining cup has a thin rim which has a lip on it which is shaped to allow the base to be held onto the retaining cup when the cup is turned relative to the base so that the elongated conductive bar is positioned in the open switch position, thereby allowing the complete assembly to be handled as a separate unit.

10 Claims, 8 Drawing Figures

Fig. 1
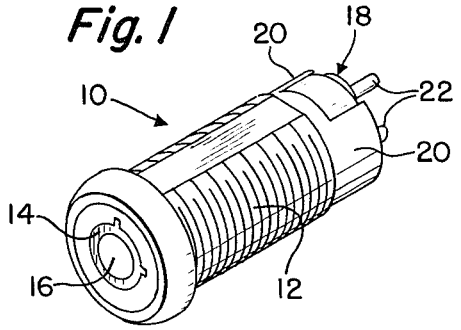
Fig. 2 PRIOR ART
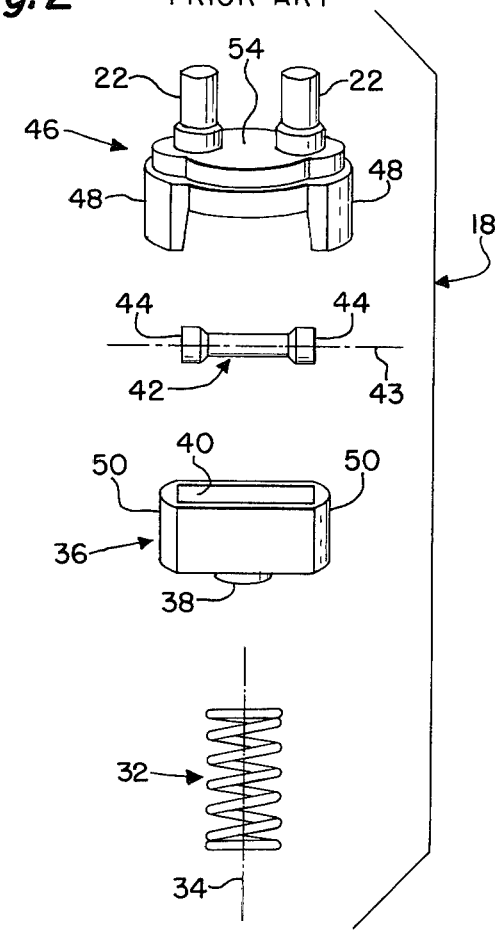
Fig. 3
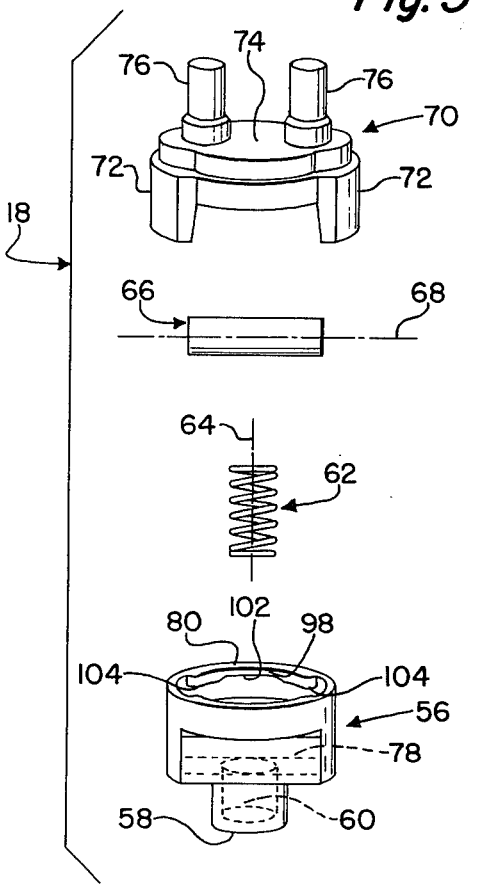
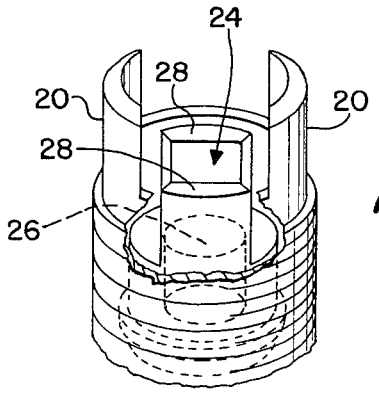
Fig. 4

Fig. 5
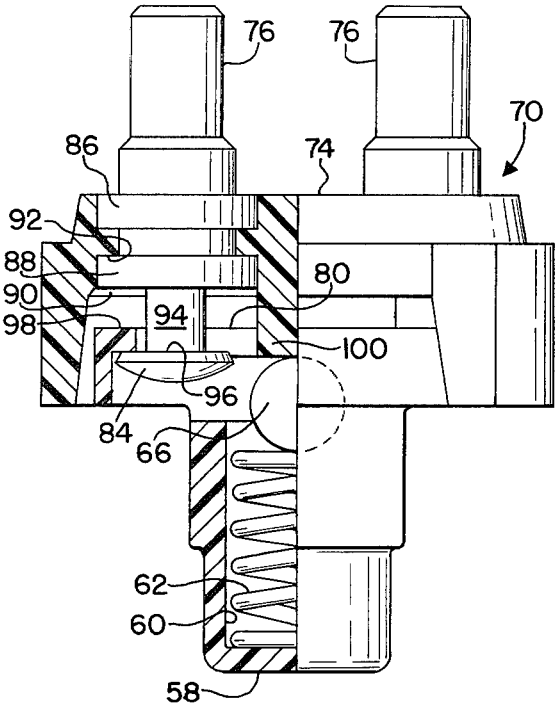
Fig. 6
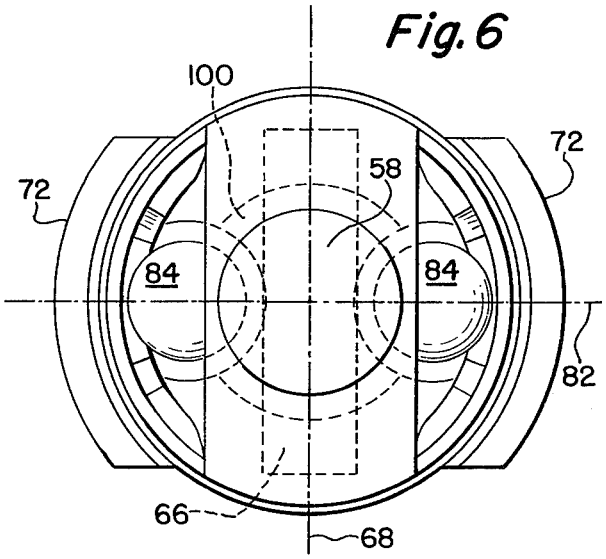
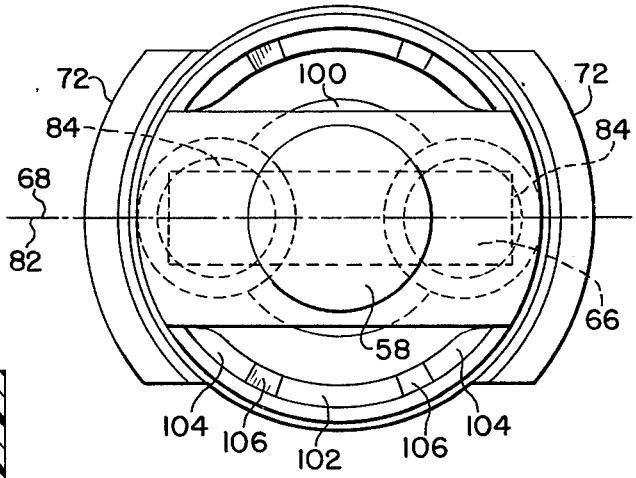
Fig. 8
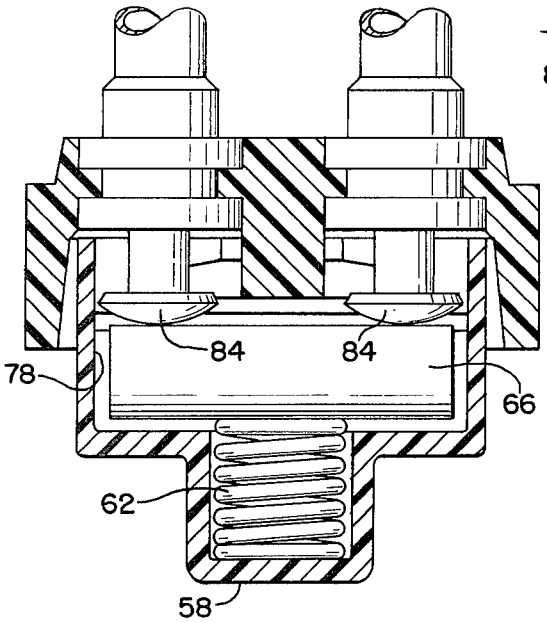
Fig. 7

ELECTRICAL KEYLOCK SWITCH

BACKGROUND OF THE INVENTION

Keylock switches are employed to actuate electrical devices in applications requiring security measures where it is desired to limit control of an electrical circuit to a keyholder. One type of such a switch is being sold by the Chicago Lock Company and is pictured in FIG. 2 of the drawings. This particular switch includes a rotatable lock mechanism which rotates relative to the fixed housing of the keylock. At the end of the keylock that is remote from the key insert portion, a blind hole is formed in a plastic member that has a pair of parallel guide arms. The lower end of a relatively large coiled spring is inserted into this blind hole and a contact retaining cup that has a circular boss on it is positioned so that the upper end of the spring encircles the boss. An elongated electrically conductive rod having a general barbell-shape is then inserted into the retaining cup so as to be retained therein when the keylock is held in a vertical position. A base member, having a pair of terminals which extended outwardly, is then pressed down over the retaining cup and against the force of the coiled spring, and a pair of clamping wings are forced inwardly over the base to hold it in place. These wings are constructed so that they secure in the base member in a a fixed position relative to the key lock housing, while allowing the retaining cup and the conductive bar to move as the keylock mechanism is turned by a key.

The described keyswitch of the Chicago Lock Company performs adequately from an electrical standpoint, however, the assembly of the switch in the keylock mechanism of the Chicago Lock Company requires a certain degree of experience to assemble, and assembly tends to be slow, since the coil spring tends to force all of the switch parts outwardly from the keylock until the clamping arms were firmly clamped over the base. Thus, both a clamping force on the arms and a pressure downwardly on the base must be applied during this assembly operation to keep the switch parts from flying out of the keylock mechanism due to the force of the coiled spring. Furthermore, the prior switch never was assembled as a complete, separate unit which could be separately packaged, stored, assembled, and tested prior to its assembly in the lock mechanism itself. The switch, of the present invention, by contrast, will fit into a keylock such as a Chicago Lock Company switch, but it also may be assembled at a remote point and then brought as a completed unit to the keylock where it may be inserted and clamped into place in a rapid, easy manner.

DESCRIPTION OF THE DRAWINGS

The present invention is described by reference to the drawings in which:

FIG. 1 is an overall perspective view of a keylock and electrical switch combination;

FIG. 2 is an exploded view of an electrical keylock switch that has previously been commercialized by the Chicago Lock Company;

FIG. 3 is an exploded view of the electrical switch of the present invention;

FIG. 4 is a partial cut-away view that shows the end of the keylock mechanism of the Chicago Lock Company which receives the switch of FIG. 3;

FIG. 5 is a side view of the electrical switch of FIG. 3 with a half cross-sectional showing of the interior of the switch with the switch in an open position;

FIG. 6 is a view of the base of the switch of FIG. 3 looking down at the inside of the switch toward the terminal heads, through the transparent retaining cup, with the switch in an open position;

FIG. 7 is a cross-sectional view of the assembled switch of FIG. 3 that shows both sides of the switch in cross section with the switch in a closed position; and FIG. 8 is a top view of the assembled switch of FIG. 3 similar to FIG. 6 but with the switch in the closed position.

TECHNICAL DESCRIPTION OF THE INVENTION

An electrical keyswitch mechanism and switch combination 10 is shown in FIG. 1. The keylock 12 itself is one that is sold commercially by the Chicago Lock Company. The keylock 12 is inserted into a vending machine or other application where security of an electrical circuit is important and is to be under the control of only people who have a mating key. The key slot 14 receives the tubular-shaped key (not shown) and rotation of the key causes the lock mechanism 16 to rotate with the key. The electrical keyswitch 18 is inserted into the end of the keylock 12 that is remote from the keyslot 14. This end has a pair of clamping wings 20 which are squeezed inwardly to retain the base 46 of the switch 18 fixed relative to the housing of the keylock. The terminals 22 project from the base 46 for electrical connection to the protected circuit.

The switch of the keylock that was previously sold by the Chicago Lock Company is shown in FIG. 2. The rotatable lock mechanism 16 of the switch is connected to a plastic receptacle 24 which has a blind circular hole 26 in it and a pair of guide arms 28 which project toward the switch-receiving end of the housing. The receptacle 24 rotates with the rotation of the lock mechanism 16. A relatively large coil spring 32 has its lower end inserted into the blind hole 26 with its elongated axis 34 projecting vertically as shown in FIG. 2. A generally rectangular-shaped retaining cup 36, which is also preferably formed of plastic, has a cylindrical boss 38 on it which is positioned so that the upper end of the coiled spring 34 encircles it. The top of the retaining cup 36 has a top opening 40 in it for receiving an elongated electrically conductive rod 42 into the retaining cup 36, the bottom of which is closed off. The electrically conductive rod 42 has a pair of larger diameter ends 44 so that the shape of the conductive rod 42 resembles a barbell. The longitudinal axis 43 of the rod 42 is substantially normal to the axis 34 of the spring 32.

The combination of the coil spring 32, the plastic retaining cup 36 and the conductive rod 42 form the moveable contact section of the switch which moves with the rotation of a lock mechanism 16 and the receptacle 24. The base 46 is formed of electrically insulating material and has a pair of downwardly extending arms 48 which project into the gaps between the two arms 20 of the receptacle to close off this end of the device. The arms 48 extend outwardly of the ends 50 of the retaining cup 36, and therefore, when the clamping wings 20 of the metallic housing of the lock mechanism are bent inwardly they will clamp upon the arms 48 of the base 46, but will allow the retaining cup 36 and the rod 42 to rotate. The electrical terminals 22 for the switch pass through the wall 54 of the base member 46 for electrical connection to the circuit being controlled.

From the description given of the prior art switch of FIG. 2, it will be appreciated that the assembly of this switch will be somewhat slower than desirable, and at times possibly even exasperating, due to the fact that the relatively large coiled spring tends to force the parts of the switch out of the receptacle 24 and the wings 20 during assembly until the wings 20 can be forced inwardly sufficiently against the arms 48 to hold the assembly in place. Thus, the switches of FIG. 2 can never be assembled at a remote location, then tested, packaged and shipped to the point to where the assembly is to be made into the keylock.

The switch of the present invention, by contrast, may be completely assembled at a remote location, tested, and then brought to the keylock assembly station and inserted into the keylock in a quick and sure manner. Consequently, while there may be similar dimensional relationships between a switch of FIG. 3 and that of FIG. 2, there are important structural differences. One of the structural differences between the prior switch and the switch of the present invention is that the retaining cup 56 of the present invention has a relatively larger cylindrical boss 58 which is inserted directly into the blind hole 26 of the receptacle 24. Another blind hole 60 is then formed in the interior of the boss 58 having a relatively smaller diameter. A relatively smaller and more closely wound coiled spring 62 is then inserted into the blind hole 60 so that its longitudinal axis 64 projects vertically as shown in FIG. 3.

The conductive rod 66 of this invention has a longitudinal axis 68 which is aligned substantially normally to the longitudinal axis 64 of the spring 62. The rod 66, however, is merely a cylindrical rod and does not require barbell ends, thereby reducing the cost of this component. The base 70 of the switch of FIG. 3 has a pair of arms 72 which are clamped by the wings 20 of the keylock in the manner described with regard to the switch of FIG. 2. It also has a wall 74 through which the electrical terminals 76 project. The conductive rod 66 is retained in a generally, elongated cavity 78 in a retaining cup 56. The retaining cup 56 has two circular rims 80 which are utilized in conjunction with the heads 84 (FIG. 5) which are formed on the terminals 76, so that the entire switch may be held together as a unit, in the manner that is described subsequently.

FIG. 5 shows the entire assembled switch of the present invention in side view with the left-half of the switch shown in cross-section. The switch of FIG. 5 shows the conductive rod 66 positioned so that its axis 68 runs normal to the line 82 (FIG. 8) that runs between the heads 84 of the terminals 76. Thus the switch is shown in its open position in FIGS. 5 and 6 and in its closed position in FIGS. 7 and 8. When the keylock mechanism 16 is rotated the retaining cup is, therefore, rotated to the position shown in FIG. 7 so that the elongated axis 68 of the rod 66 is now positioned parallel to the line 82. In this position, the conductive rod 66 makes contact with the heads 84, thereby completing the electrical circuit between the terminals 76.

Terminals 76 are preferably formed with a pair of enlarged integral rings 86, 88 which are located one above the other at a spaced-apart distance so as to increase the holding strength of the terminal in the molded, electrically insulating base 70, which is preferably formed of phenolic, or other suitable insulating material. The lower surface 90 of the ring 88 projects beyond the lower surface 92 of the interior of the base 70 and the head 84 is displaced from the surface 90 by the small diameter extension segment 94. This, of course, leaves a gap between the upper surface 96 of the head 84, and the lower surface 90 of the ring 88. This gap allows the inwardly directed lips 98 of the rims 80 to be loosely retained between the upper surface 96 of the terminal head 84 and the lower surface 90 of the enlarged ring 88 so the entire switch may be preassembled as a complete unit so the retaining cup 56 may be pushed back and forth towards the base 70 against the force of the spring 62.

When the switch is assembled, with the switch in the open position, as shown in FIG. 5, it may be transported as a complete switch unit to an assembly station, where it is inserted into the keylock. It is to be noted that when the switch is in the closed position, as shown in the cross-sectional view of FIG. 7, the lips 98 of the rims 80 are no longer retained between the head 84 and the ring 88, and thus, the retaining cup 56 may be removed from the base 70. Therefore, in the assembly of the switch, it is inserted into the receptacle 24 in its open position and then the retaining cup 56 is rotated by the receptacle to the open position when the clamping wings 20 are forced toward the wings 72 on the base 70. The base 70 is preferably formed with the raised barrier 100 which extends between the heads 84 so as to provide additional insulation insurance between them. This raised barrier also provides a supporting surface for the rod 66 when the switch is in the open position, as shown in FIG. 5.

The rims 80 of the retaining cup 56, as previously described, are loosely retained to the base by the interaction of the lips 98 and the head 84. The rims 80 are preferably formed with detents which keep the retaining cup 36 from rotating relative to the base 70 during shipment. These detents consist of a central segment 102 which is thinner than the outer segments 104 of the rims 80 and the ramp areas 106 that provide the transition between the segments 102 and the segments 104.

What is claimed is:

1. A keylock switch comprising a base which supports a pair of electrical terminals that pass therethrough, said electrical terminals having enlarged heads that are spaced from said base to form gaps therebetween and are aligned along a contact line that intersects said heads, a retaining cup comprising an elongated retaining cavity, a cylindrical boss that has an inner circular blind hole and a securing means spaced from said boss, a coiled spring having an elongated axis, one end of which is inserted into said blind hole, an elongated electrically conductive rod, having an elongated axis that is substantially normal to the axis of said coiled spring, which contacts the other end of said spring and which is retained in said retaining cavity so that said axis of said rod will overlap said contact line and said rod will contact said heads when said retaining cup and said rod are rotated relative to said base so that said switch is in the closed position, said securing means being rotated into supporting engagement with said heads when said retaining cup and said rod are rotated relative to said base so that said switch is in the open position and said rod is positioned substantially normal to said contact line whereby a complete switch assembly, that may be transported as a unit, is provided in the open switch position.

2. A keylock switch as claimed in claim 1 wherein a raised insulation barrier is provided between said heads and said conductive rod engages said insulation barrier when said switch is in the open position.

3. A keylock switch as claimed in claim 1 wherein said securing means comprises a pair of rims each of which includes a lip that enters into one of said gaps between one of said heads and said base so that it is engaged by said head when said switch is in the open position.

4. A keylock switch as claimed in claim 3 wherein said rims have detents formed thereon which comprise a central thinner segment that is joined to two thicker end segments by a transition ramp.

5. A keylock switch as claimed in claim 4 wherein a raised insulation barrier is provided between said heads and said conductive rod engages said insulation barrier when said switch is in the open position.

6. A keylock switch for installation into a keylock having a rotatable keylock mechanism, a keyswitch receptacle that rotates with said keylock mechanism and has a blind circular hole therein and clamping wings for securing said keyswitch in said keylock, comprising a base which supports a pair of electrical terminals that pass therethrough, said electrical terminals having enlarged heads that are spaced from said base to form gaps therebetween and are aligned along a contact line that intersects said heads, a retaining cup comprising an elongated retaining cavity, a cylindrical boss that is inserted into said blind hole in said receptacle and has an inner blind circular hole of a smaller diameter than the diameter of said blind hole in said receptacle, and securing means spaced from said boss, a coiled spring having an elongated axis, one end of which is inserted into said blind hole, an elongated electrically conductive rod, having an elongated axis that is substantially normal to the axis of said coiled spring, which contacts the other end of said spring and which is retained in said retaining cavity so that said axis of said rod will overlap said contact line and said rod will contact said heads when said retaining cup and said rod are rotated relative to said base so that said switch is in the closed position, said securing means being rotated into supporting engagement with said heads when said retaining cup and said rod are rotated relative to said base so that said switch is in the open position and said rod is positioned substantially normal to said contact line whereby a complete switch assembly that may be transported as a unit is provided in the open switch position.

7. A keylock switch as claimed in claim 6 wherein a raised insulation barrier is provided between said heads and said conductive rod engages said insulation barrier when said switch is in the open position.

8. A keylock switch as claimed in claim 6 wherein said securing means comprises a pair of rims each of which includes a lip that enters into one of said gaps between one of said heads and said base so that it is engaged by said head when said switch is in the open position.

9. A keylock switch as claimed in claim 8 wherein said rims have detents formed thereon which comprise a central thinner segment that is joined to two thicker end segments by a transition ramp.

10. A keylock switch as claimed in claim 9 wherein a raised insulation barrier is provided between said heads and said conductive rod engages said insulation barrier when said switch is in the open position.

* * * * *